US011702854B2

(12) United States Patent
Foy et al.

(10) Patent No.: US 11,702,854 B2
(45) Date of Patent: Jul. 18, 2023

(54) SPA STRUCTURE

(71) Applicant: 9213-4550 QUÉBEC INC., Drummondville (CA)

(72) Inventors: Jérôme Foy, Orford (CA); Gaston Ouellet, Sherbrooke (CA); Charles Goulet, Drummondville (CA)

(73) Assignee: JÉRÔME FOY DESIGN INDUSTRIEL INC., Orford (CA)

( * ) Notice: Subject to any disclaimer, the term of this patent is extended or adjusted under 35 U.S.C. 154(b) by 233 days.

(21) Appl. No.: 17/319,275

(22) Filed: May 13, 2021

(65) Prior Publication Data

US 2021/0355700 A1 Nov. 18, 2021

Related U.S. Application Data

(60) Provisional application No. 63/025,038, filed on May 14, 2020.

(51) Int. Cl.
*E04H 4/00* (2006.01)

(52) U.S. Cl.
CPC ..... *E04H 4/0037* (2013.01)

(58) Field of Classification Search
CPC ..... E04H 4/0037
See application file for complete search history.

(56) References Cited

U.S. PATENT DOCUMENTS

| | | | | |
|---|---|---|---|---|
| 5,201,562 | A * | 4/1993 | Dorsey | B60R 13/01 4/492 |
| 7,802,324 | B2 | 9/2010 | Layfield et al. | |
| 8,881,321 | B1 * | 11/2014 | Ludlow | E04H 4/0037 4/506 |
| 2009/0064405 | A1 | 3/2009 | Spicer | |
| 2021/0095488 | A1 * | 4/2021 | Tulett | A61H 33/6005 |

* cited by examiner

*Primary Examiner* — Christine J Skubinna
(74) *Attorney, Agent, or Firm* — Alexandre Daoust; Norton Rose Fulbright Canada LLP

(57) ABSTRACT

A spa having a rotomolded unibody shell defining a basin, an upper edge surrounding the basin, a peripheral wall, a cavity between the basin and the peripheral wall. The peripheral wall having at least one opening leading to the cavity. The spa including a frame, decoupled from the spa shell, in the form of a plurality of individual components introducible into the cavity within the shell via the opening in the shell, and assemblable to one another inside the shell. The frame including side beams and couplers in continuous abutment with the upper edge of the shell, offering a superior structure and support.

20 Claims, 10 Drawing Sheets

SPA STRUCTURE

FIELD

The improvements generally relate to the field of spas, and more specifically to spas having a rotationally-moulded shell.

BACKGROUND

Spas, alternatively referred to as portable spas, hydrotherapy spas or hot tubs are increasingly widespread. Given that spa commercialization is highly competitive, there is a significant pressure on costs, and, to a certain extent, spas can be classified on the basis of their method of manufacture. Some spas have a basin made by rotational molding, also known as rotomolding. Rotomolded spas have several advantages, and have been satisfactory to a certain degree, but there always remains room for improvement. For-instance, the rotomolding fabrication process causes certain challenges in terms of incorporating structure to the moulded part while also achieving secondary objectives such as moulding efficiency and total amount of plastic material used, etc., the latter affecting the costs significantly. From the point of view of the structural aspect, not only should the structure be adapted to withstand, sporadically and over time, the weight of the contained water and of the bathers, but especially in cold climates, the structure should be adapted to support the weight of a spa cover/hood. The upper edge of the spa, often already loaded with the weight of the water, and where the user often steps or leans on to enter or exit the basin, is particularly vulnerable to deformation. When loaded or simply during use, the top portion of the basin may warp from its original straight profile, causing undesired stress to be applied to the shell, improper sealing with a spa cover and associated energy inefficiencies, premature failure of the material and/or an overall unappealing look, and all these factors militate in favor of over-designing the rotomolded component's structure.

SUMMARY

In accordance with one aspect, there is provided a spa comprising a unibody shell defining a basin, an upper edge surrounding the basin, a peripheral wall, a cavity between the basin and the peripheral wall, and at least one opening in the peripheral wall leading to the cavity, and a frame having a plurality of components, each component of the frame being configured for occupying a respective position in the cavity, each component of the frame being configured to be introducible into the cavity, and placed in the respective position, via said at least one opening in the outer wall, so as to be assemblable into the frame within the cavity.

In accordance with another aspect, there is provided a spa having a basin, a peripheral wall surrounding the basin, at least one opening in the peripheral wall, at least one panel having external edges including two opposite lateral edges slanted off vertical towards one another and forming a tapered shape in the vertical orientation, the opening having internal edges forming a tapered shape matching with the tapered shape of the panel, the internal edges configured to form a male-female engagement with the external edges, wherein the panel can be assembled to close the opening by first positioning the panel in a plane of the opening, in a position vertically offset, towards the width of the taper, from the position of the opening, secondly sliding the panel from the vertically offset position towards the narrow of the taper, into a vertically aligned position, thereby engaging the external edges with the internal edges, and locking the panel into its vertically aligned position to lock the male-female engagement between the internal edges and the external edges.

Many further features and combinations thereof concerning the present improvements will appear to those skilled in the art following a reading of the instant disclosure.

DESCRIPTION OF THE FIGURES

In the figures.

DETAILED DESCRIPTION

Figure 1:
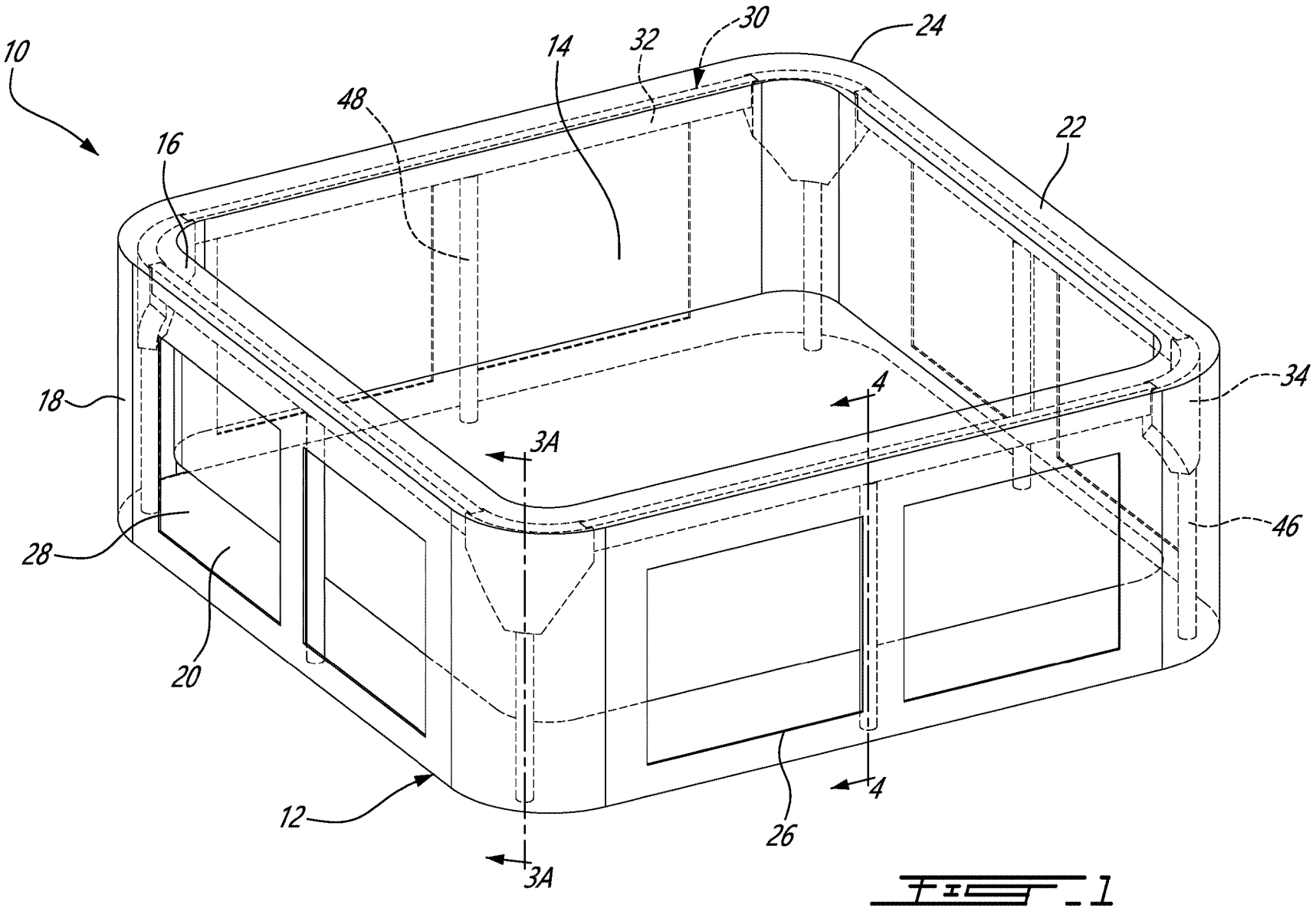
FIG. 1 is an oblique view of an embodiment of a spa.

FIG. 1 shows an oblique view of example spa 10, including a rotomolded unibody shell 12 defining a basin 14, wherein water and bathers are to be contained, an upper edge 16 surrounding the top of the basin 14, a peripheral wall 18 and a base 20, the peripheral wall 18 extending generally vertically from the upper edge 16 downwardly towards the base 20, the base 20 extending generally horizontally under the basin 14. In this example, the spa 10 is rectangular in shape and contains side portions 22, corresponding to the substantially linear portions of the shell 12, and corner portions 24 corresponding to be substantially curved portions of the shell 12 found at the intersection of two side portions 22. The side portions 22 of the peripheral wall 18 contain openings 26, giving access to a cavity 28 defined between the basin 14 and the peripheral wall 18 as well as the basin 14 and the base 20.

To obtain a superior structure, the introduction of support elements in the shell of a spa is acceptable to a certain extent, but limitations are imposed by the material properties and the design of the mold used to make the spa shell. The introduction of the support elements requires openings that are often limited in number and size as they weaken the initial shell of the spa providing support. Thus, the introduction of support elements are often limited. Further, mounting the support structure to specific regions of the rotomolded shell causes unwanted stress due to mismatched thermal expansion coefficients between the different materials. As will be discussed below, providing a frame 30, decoupled from the spa shell 12, in the form of a plurality of individual components introducible into the cavity 28 within the shell 12 via the openings 26 in the shell 12, and assemblable to one another inside the shell 12 can be useful in incorporating structure to a rotomolded spa.

Figure 2B:
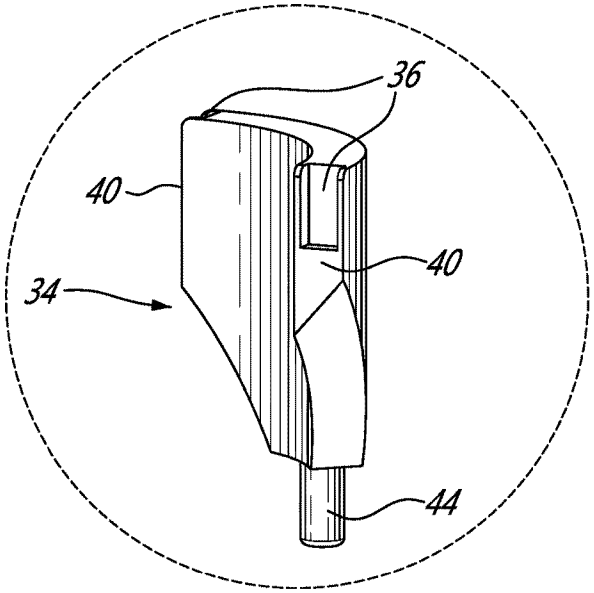
FIG. 2B is the portion 2B-2B of FIG. 2A, shown enlarged.
Figure 2C:
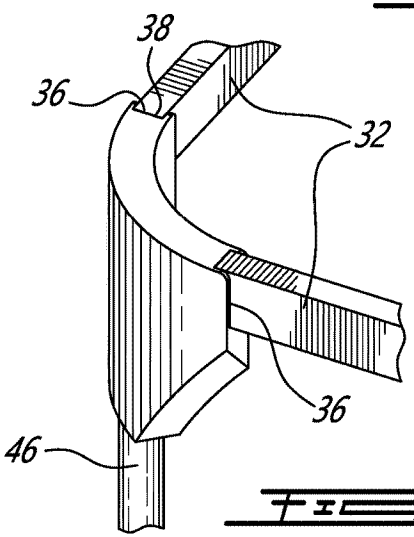
FIG. 2C shows a coupler of the frame in the spa of FIG. 1 mounted with the side beam and the corner shaft.
Figure 2A:
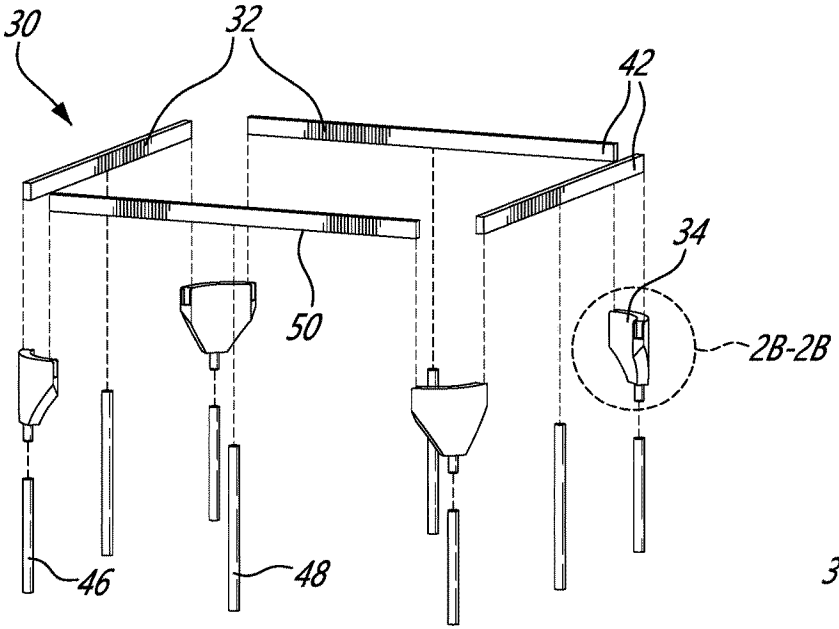
FIG. 2A is an exploded view of the frame in the spa of FIG. 1.

In the example embodiment of FIG. 1, the spa contains a plurality of individual components assembled into a frame 30 within the shell 12 cavity 28. FIG. 2A shows an exploded view of the frame 30 of FIG. 1. In this example, the frame 30 has side beams 32, capable of being mounted onto couplers 34. As perhaps best seen in FIGS. 2B-2C, the couplers 34 have slots 36 with upward facing openings 38 on either lateral side 40 capable of receiving the side beam's extremities 42. The coupler 34 further has a peg 44 extending downwardly and configured to receive a corner shaft 46. As will be discussed further below, the frame 30 further has side shafts 48 capable of being placed along the side portions 22 of the spa 10, between two couplers 34, in abutment with the underside of the side beams 50.

In this example, the corner and side shafts 46, 48 are hollow throughout their length. It can however be understood that, in alternate embodiments, the corner and side shafts 46, 48 are only hollow for portions of their length or, in the case of the side shaft 48, solid throughout. Similarly, in this particular embodiment, the side beams 32 have rectangular cross-sections and are made of dimensional lumber. It can be understood that, in alternative embodiments, alternate cross-sectional structures can be used such as H-shaped cross-sections, I-shaped cross-sections, T-shaped cross-sections, L-shape cross-sections, C-shape cross-sections, U-shaped cross-sections, circularly-shaped cross-sections, pipe-shaped cross-sections, etc. Further, it can be understood that alternate materials to dimensional lumber, such as thermoplastics, plastic composites, composite wood, metal matrix composites, steel, etc., can be used without departing from the present disclosure.

In this particular example, the side beam 32 is the male connector and the slot 36 on the coupler 34 is the female connector with respect to the mounting of the side beam 32. Similarly, the peg 44 is the male connector and the corner shaft 46 is the female connector with respect to the mounting of the corner shaft 46. It can be understood that the mounting method and the type of connection between these components can vary without departing from the present disclosure.

Returning to FIG. 1, the frame 30 can be introduced into the cavity 28 through one or a plurality of the openings 38 found on the peripheral wall 18 of the shell 12 and assembled inside the cavity 28. The side beams 32 are to be placed along the side portions 22 of the spa 10, in abutment with the upper edge 16 of the shell 12 and mounted in the slots 36 of the couplers 34. The couplers 34 are placed in the corner portions 24 of the spa 10, also in abutment with the upper edge 16 of the shell 12 and held in place by the corner shaft 46 engaged with the peg 44.

Figure 3B:
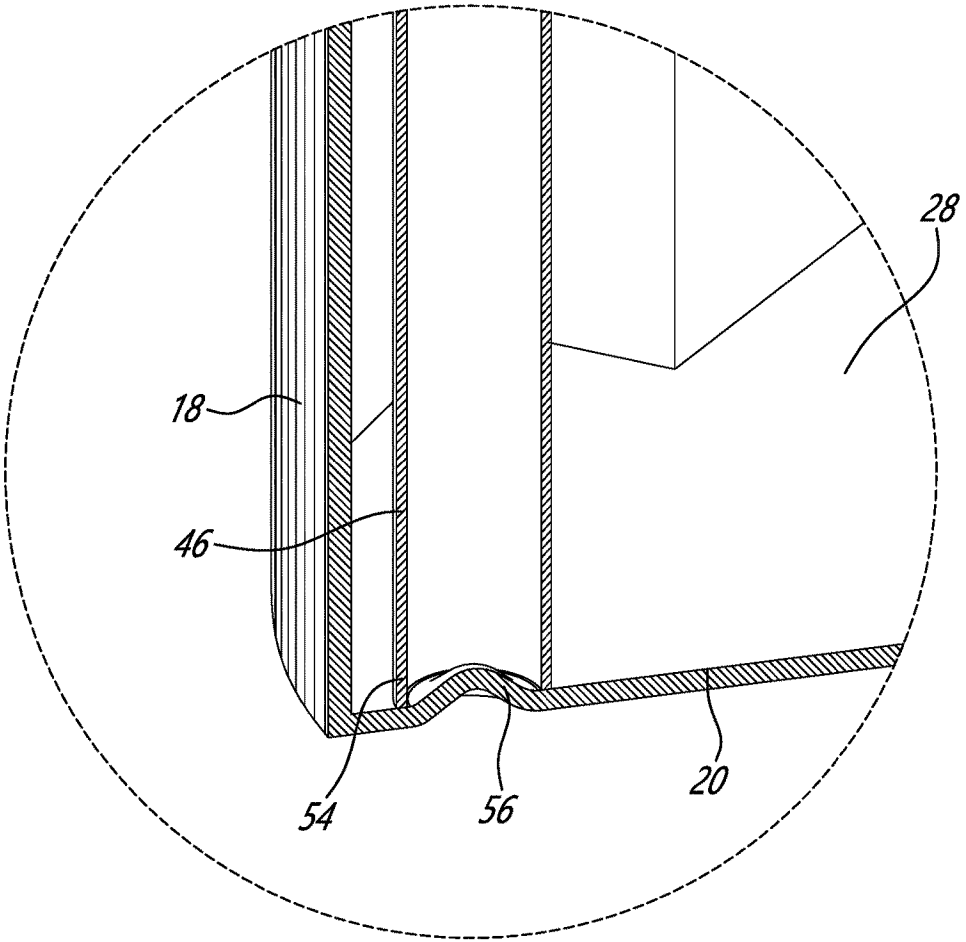
FIG. 3B is the portion 3B-3B of FIG. 3A, shown enlarged.
Figure 3A:
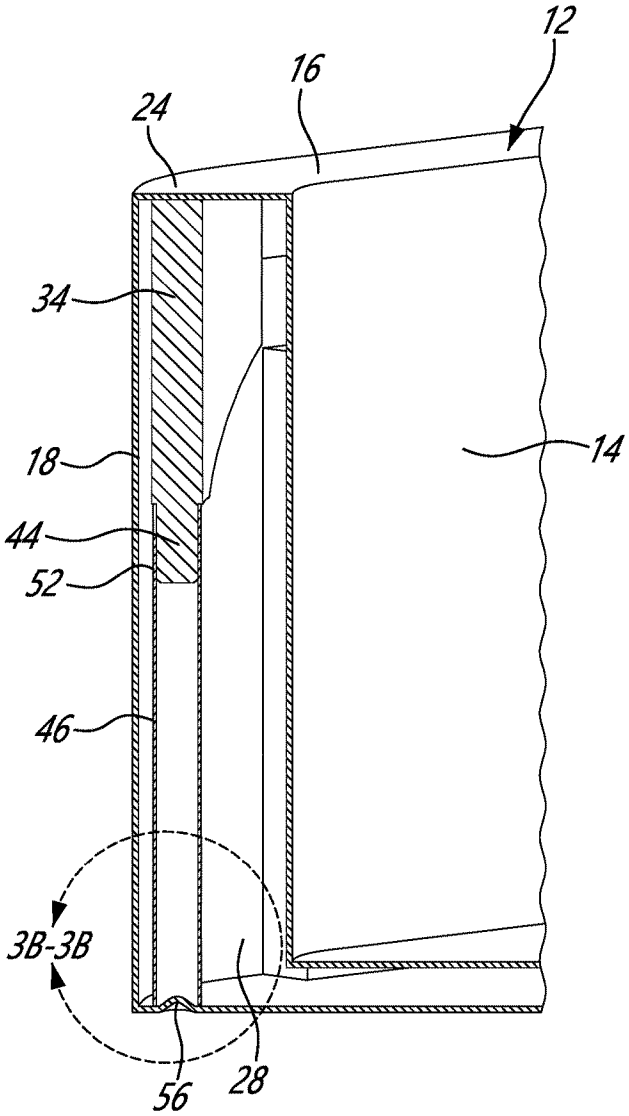
FIG. 3A shows the section 3A-3A of FIG. 1.

As perhaps best seen in FIG. 3A, showing section 3A-3A of FIG. 1, the coupler 34 is placed in the corner portion 24 of the spa 10 in abutment with the upper edge 16 of the shell 12. A first extremity 52 of the corner shaft 46 is engaged with the peg 44 of the coupler 34 and a second extremity 54 of the corner shaft 46 is engaged with a locating bulge 56 found on the base 20 of the shell 12, protruding inwardly towards the cavity 28. It can be understood that, in alternate embodiments, the locating bulge 56 may be removed or replaced by any other suitable locating method such as locating pin, a void, a fastener, etc. without departing from the present disclosure.

Figure 4:
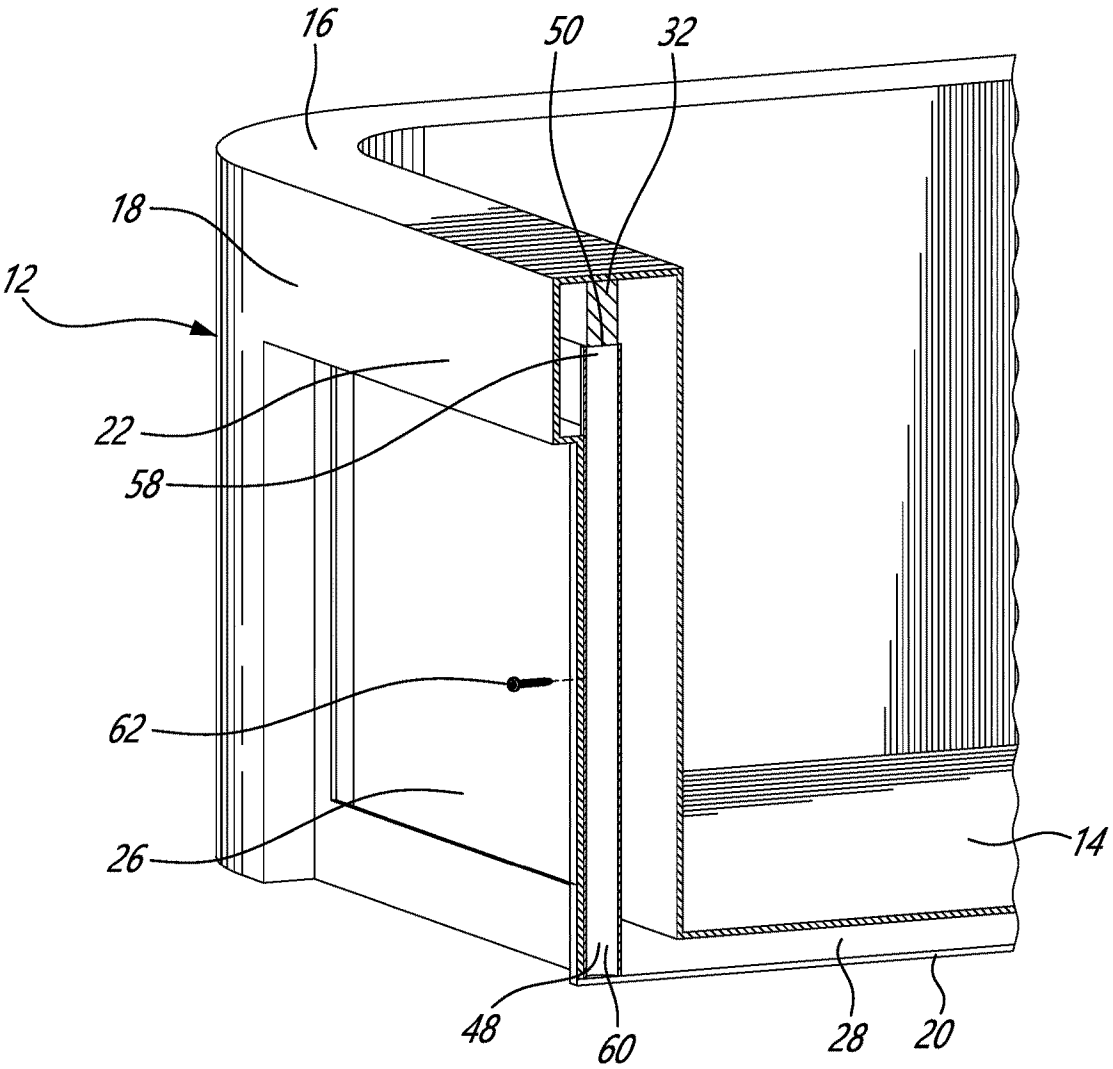
FIG. 4 shows the section 4-4 of FIG. 1.

Returning to FIG. 1, in this example, the side beams 32 are further supported by side shafts 48, placed under the side beam 32 and between two couplers 34. In this example, and perhaps best seen in FIG. 4, showing section 4-4 of FIG. 1, the side shaft 48 is placed on the side portion 22 of the spa 10 and against a portion of the peripheral wall 18, so as to have a first extremity of the side shaft 58 in abutment with the underside of the side beam 50 and a second extremity of the side shaft 60 in abutment with the base 20 of the shell 12. The side shaft 48 being held to the peripheral wall 18 via a shaft fastener 62. It can be understood that the shaft fastener 62 can be removed or replaced by any other suitable fixation method, such as a pin or a locating bulge at the base 20 of the shell 12, for example.

Returning to FIG. 1, once assembled the frame's side beams 32 and couplers 34 are in continuous abutment with, but decoupled from, the upper edge 16 of the shell 12. The frame 30 offers a superior structure and support, helping it maintain lateral rigidity while minimizing local deformation and thermal deformation related stress.

Figure 5:
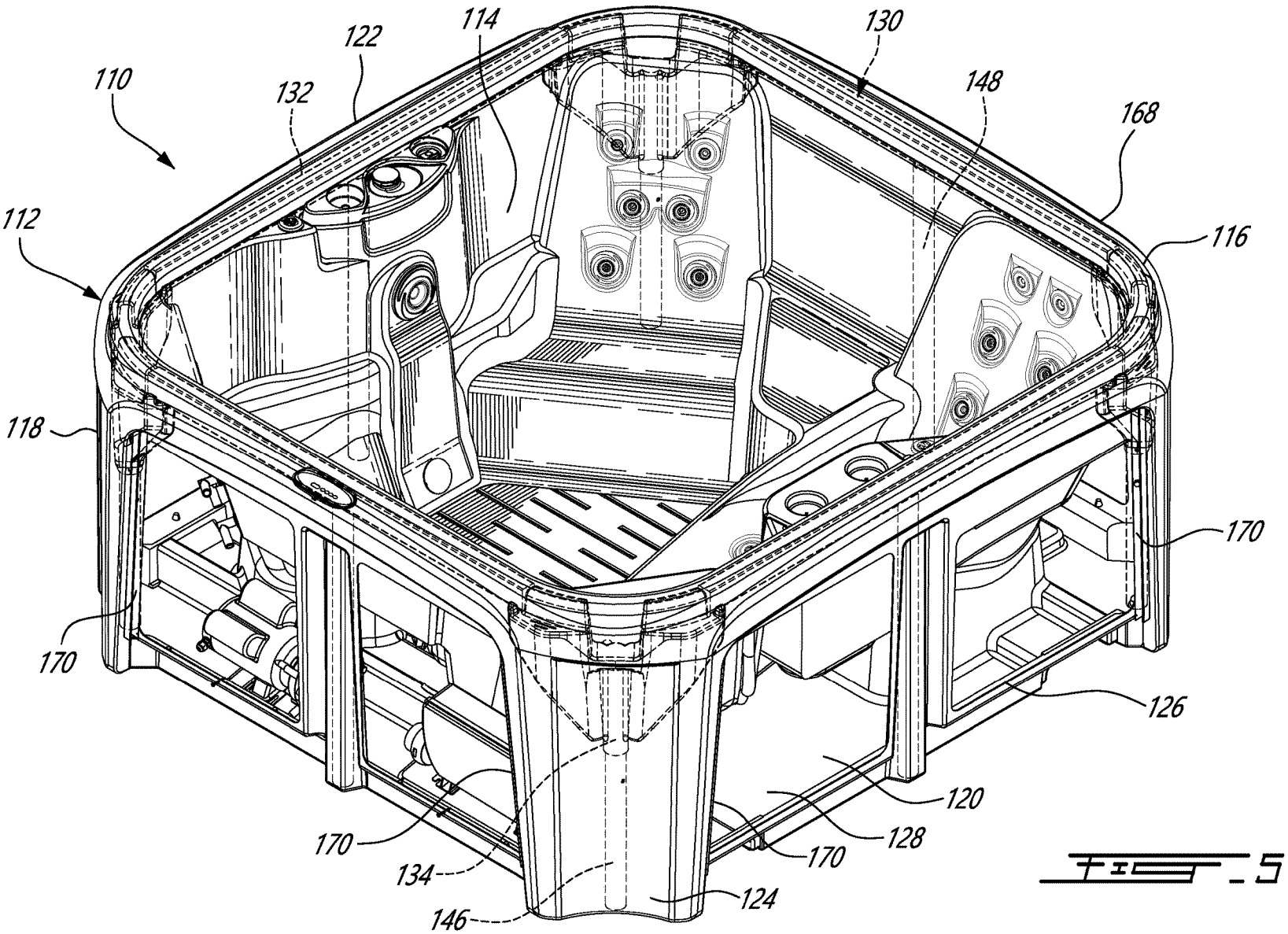
FIG. 5 is an oblique view of another embodiment of a spa.
Figure 6:
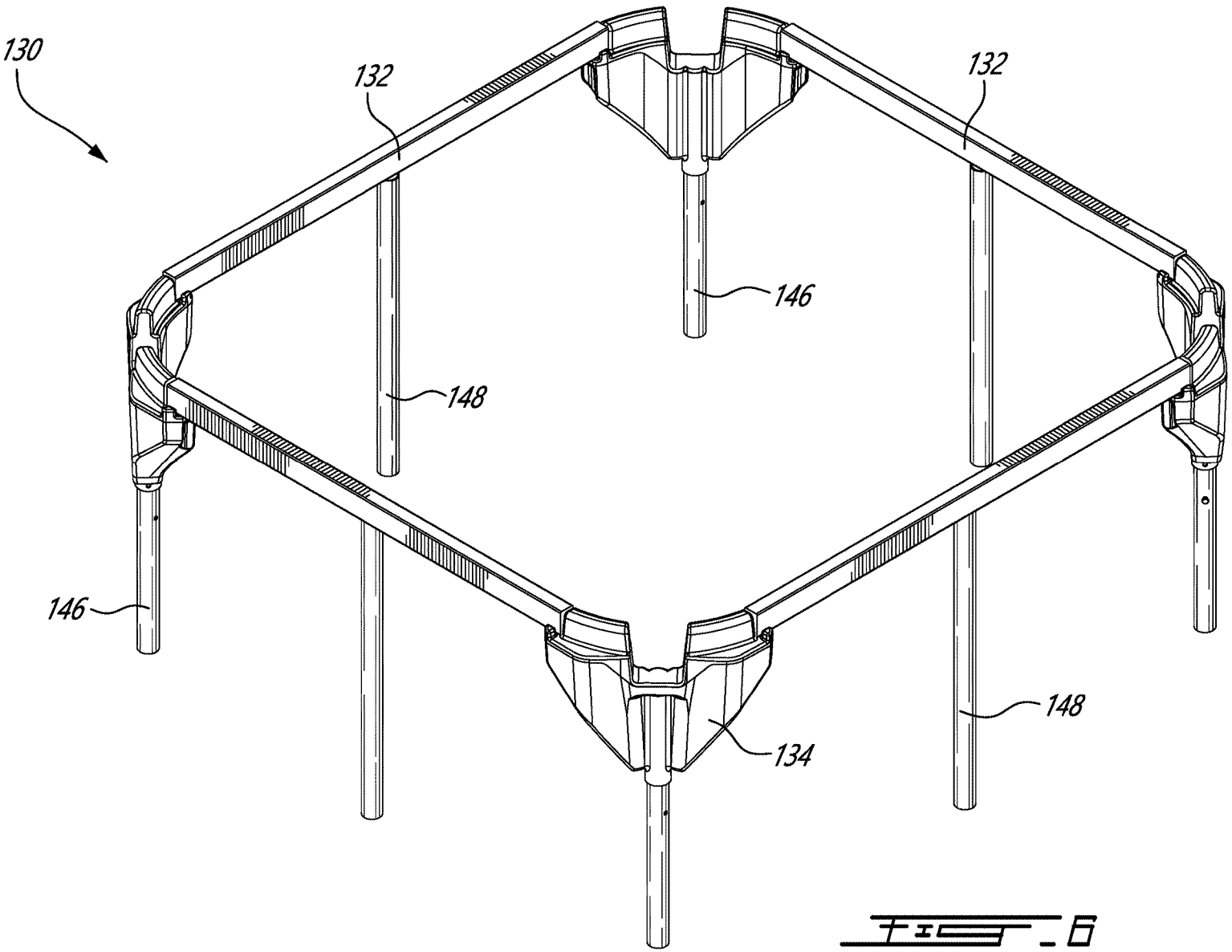
FIG. 6 is an oblique view of the frame of the spa in FIG. 5.

Attention is now brought to FIG. 5, showing another embodiment of a spa 110. The spa 110 having a rotomolded unibody shell 112 defining a basin 114, an upper edge 116, a peripheral wall 118 and a base 120. The spa 110 having side portions 122 and corner portions 124, wherein the side portion 122 includes openings 126 leading to a cavity 128 defined between the basin 114 and the peripheral wall 118 as well as the basin 114 and the base 120. The spa 110 contains an assembled frame 130 with side beams 132 and couplers 134 in continuous abutment with, but decoupled from, the upper edge 116 of the shell 112. FIG. 6 shows the assembled frame 130 of the example embodiment in FIG. 5, having side beams 132, couplers 134, side shafts 148 and corner shafts 146, capable of being introduced into the cavity 128 of the shell 112 as individual components through one or various openings 126 of the peripheral wall 118 and assembled within the cavity 128 of the shell 112.

Figure 7B:
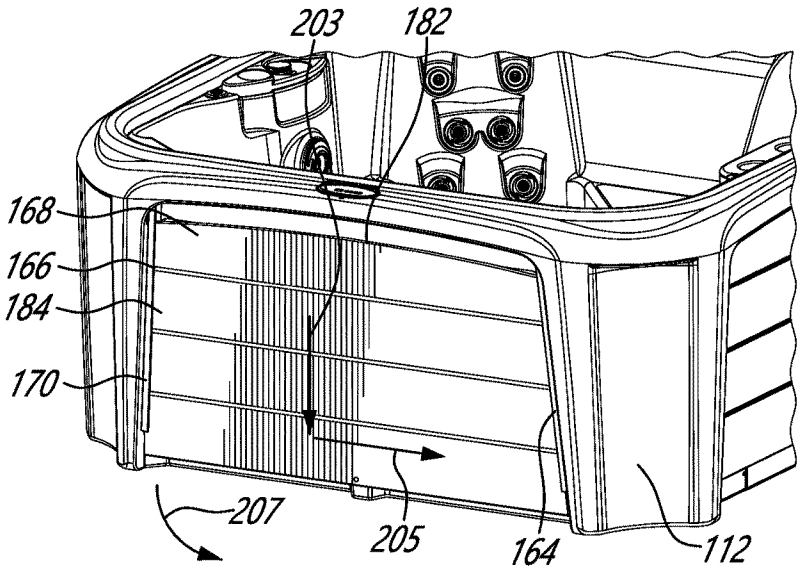
FIGS. 7A, 7B and 7C are oblique views of the spa in FIG. 5 with incremental movements of the panel for removal.
Figure 7A:
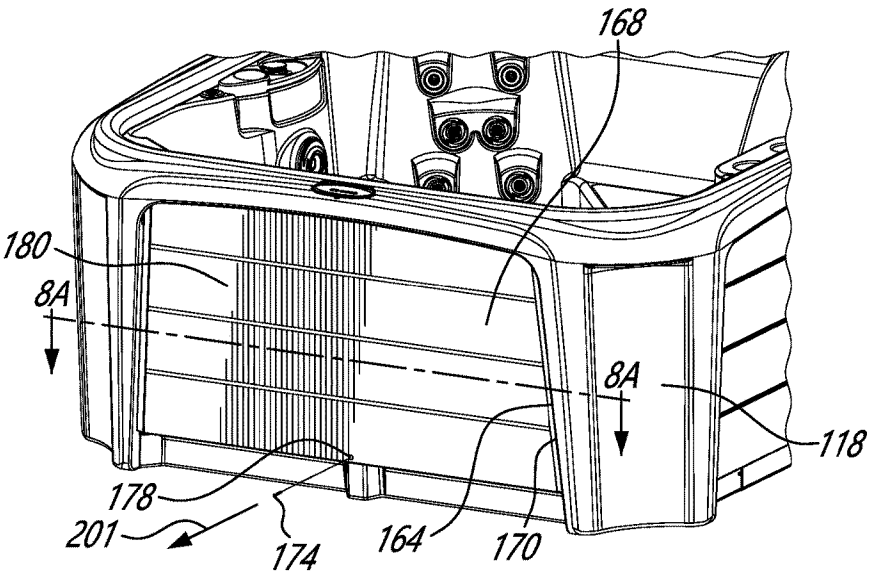
Figure 7C:
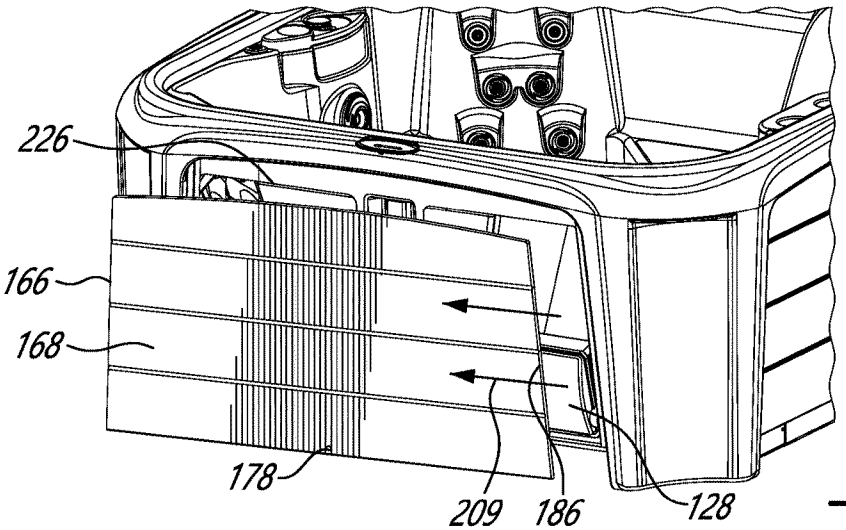

In the illustrated embodiment, and perhaps best seen in FIGS. 7A-7C, the side portions 122 of the peripheral wall 118 further contain internal edges 164 configured to receive external edges 166 of a panel 168 in a male-female engagement. In this embodiment, the internal edges 164 define grooves 170. The panel 168 having opposite lateral edges 172 slanted off vertical towards one another forming a tapered shape, as perhaps best seen in FIG. 8B. The shell grooves 170 forming a tapered shape matching with the tapered shape of the panel 168. The panel 168 securable to the peripheral wall 118 via a panel fastener 174 inserted into the panel fastener hole 178, being placed centrally within the face 180 of the panel 168. The panel 168 is removable from the shell 112 by removing the panel fastener 201, as shown in FIG. 7A, sliding the panel downwards 203 and towards one of the lateral edges 205, releasing the narrow edge 182 and complementary lateral edge 184 of the panel 168 from the groove 170, and pivoting the panel outwardly 207, away from the shell 112 and the cavity 128, as shown in FIG. 7B. The panel 168 is then released from the shell 112 by pulling the remaining lateral edge 186 away from the groove 209. It can be understood that the panel 168 can conversely be inserted into the grooves 170 of the shell by reversing the steps of the removal. It can further be understood that the external edges 166 are the male elements and the internal edges 164 are the female elements of the male-female engagement in this embodiment, but that the role of these components can be altered without departing from the present disclosure.

Figure 8A:
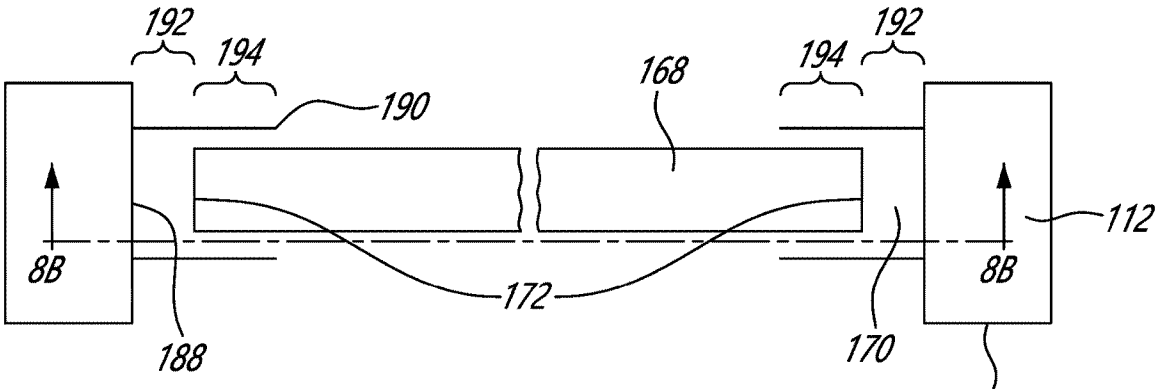
FIG. 8A shows the section 8A-8A of FIG. 7A.
Figure 8B:
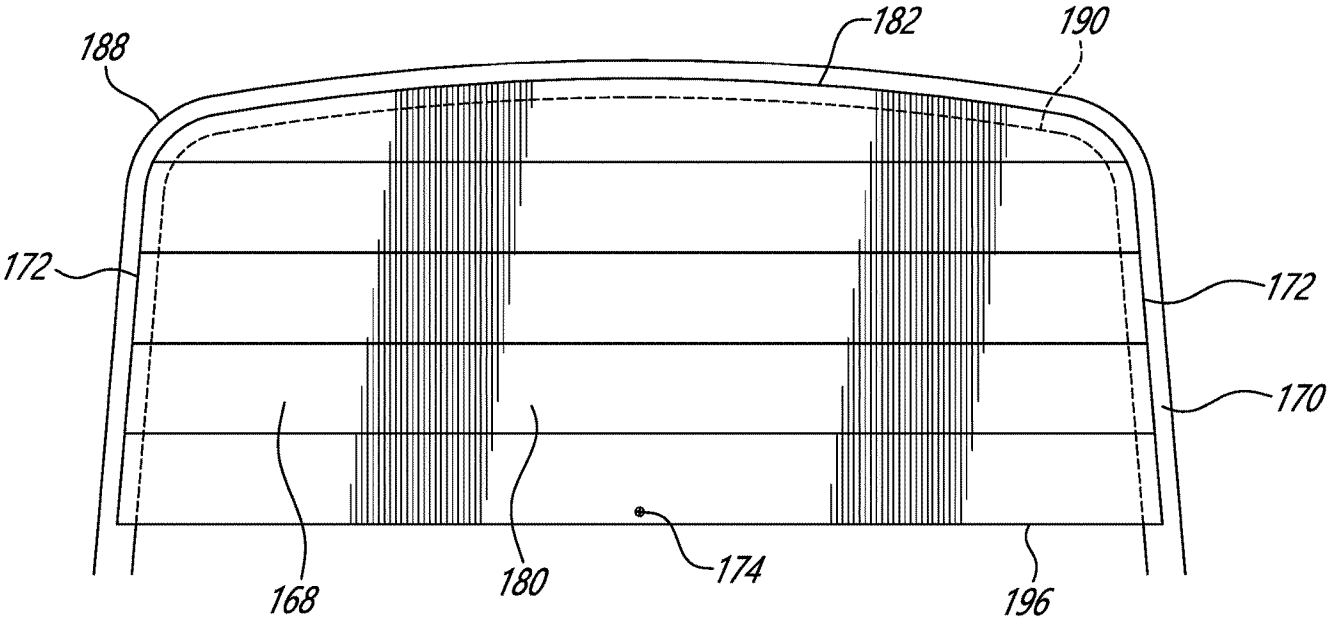
FIG. 8B shows the section 8B-8B of FIG. 8A.

Attention is now brought to FIGS. 8A and 8B, showing section 8A-8A of FIG. 7A and section 8B-8B of FIG. 8A, respectively. When the panel 168 is in the inserted position and with the panel fastener 174 in place, the two lateral edges 172 are held between the groove root 188 and groove tip 190 of the grooves 170 on either lateral side of the panel 168. The dimensions of the grooves 170 in the shell 112 are so that the lateral edges 172 of the panel 168 in the inserted position are between the groove root 188 and groove tip 190, so as to allow a certain tolerance for thermal expansion, which can be identified as the thermal expansion tolerance 192, or contraction, which can be identified as the thermal contraction tolerance 194, of the materials of the panel 168 and of the spa shell 112. When the panel 168 is in the inserted position and with the panel fastener 174 in place, the narrow edge 182 of the panel 168 is held in the groove 170 between the groove root 188 and the groove tip 190, with a thermal expansion 192 and thermal contraction tolerance 194 length to accommodate thermal deformation of the materials. The thermal expansion tolerance 192 is the total amount of expansion of the panel 168 towards the shell 112 and/or expansion of the shell 112 towards the panel 168, along the plane of the panel 168, the spa 110 can be subject to before any stresses are applied by the panel 168 to the shell 112 and reversely form the shell 112 to the panel 168. The thermal contraction tolerance is the total amount of contraction of the panel 168 away from the shell 112 and/or contraction from the shell 112 away from the panel 168, along the plane of the panel 168, the spa 110 can be subject to before the panel is no longer held by the groove 170.

In this particular embodiment, it is understood that the panel 168 has a long edge 196 oriented towards the base 120 of the spa 110, a narrow edge 182 oriented towards the upper edge 116 of the spa 110, and that the groove 170 contains a shape generally corresponding to that of the panel 168. It will, however, be understood that, in an alternative embodiment, the long edge 196 may be oriented towards the upper edge 116 of the spa 110 and the narrow edge 182 towards the base 120 of the spa 110, with the groove 170 also being oriented to correspond to the panel 168 orientation.

Figure 9:
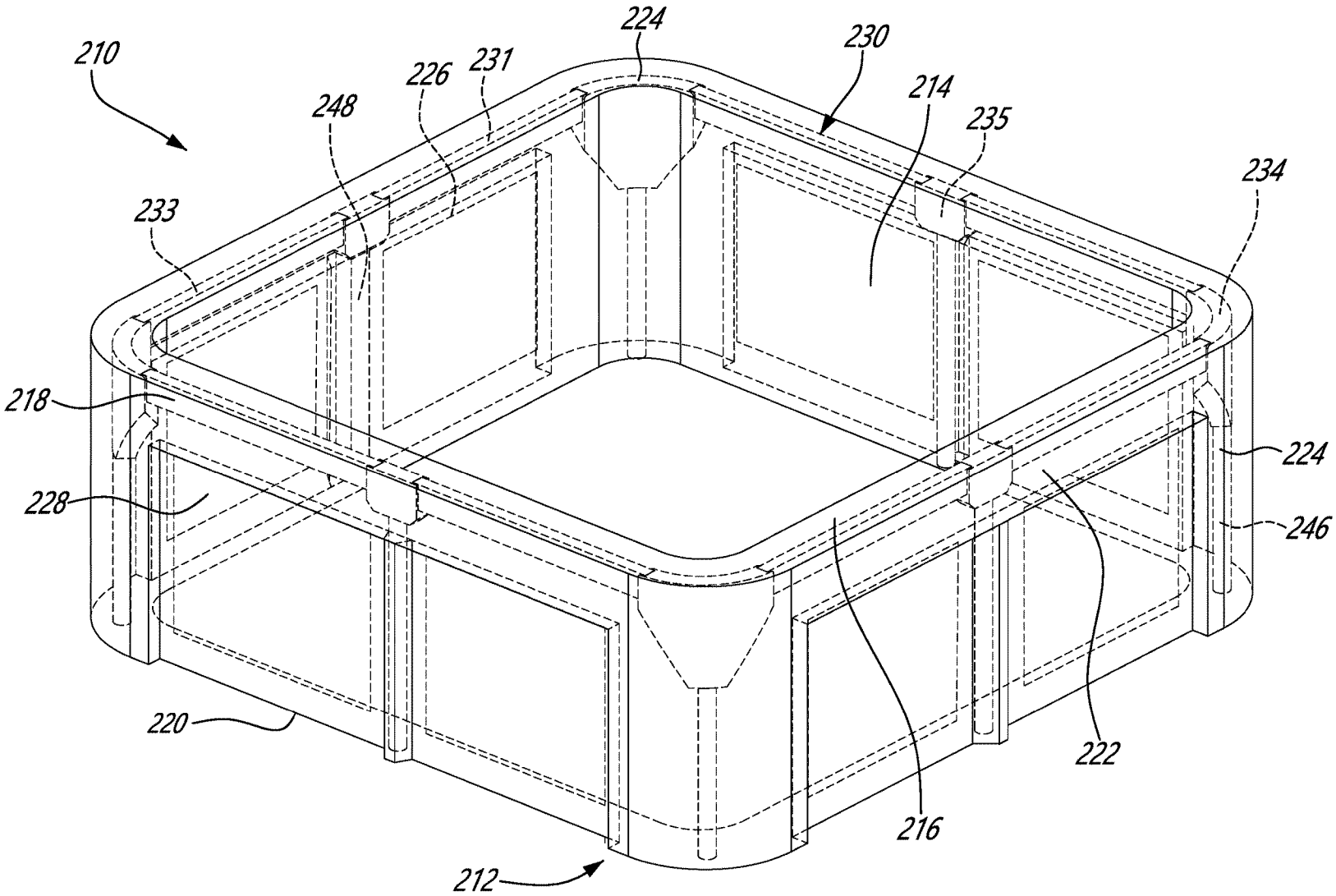
FIG. 9 is an oblique view of another embodiment of a spa.

Attention is now brought to FIG. 9, showing yet another embodiment of a spa 210. The spa 210 having a rotomolded unibody shell 212 defining a basin 214, an upper edge 216, a peripheral wall 218 and a base 220. The spa 210 having side portions 222 and corner portions 224, wherein the side portions 222 include openings 226 leading to a cavity defined between the basin 214 and the peripheral wall 218 as well as the basin 214 and the base 220. The spa 210 containing a plurality of individual components assembled into a frame 230 within the cavity 212.

Figure 10B:
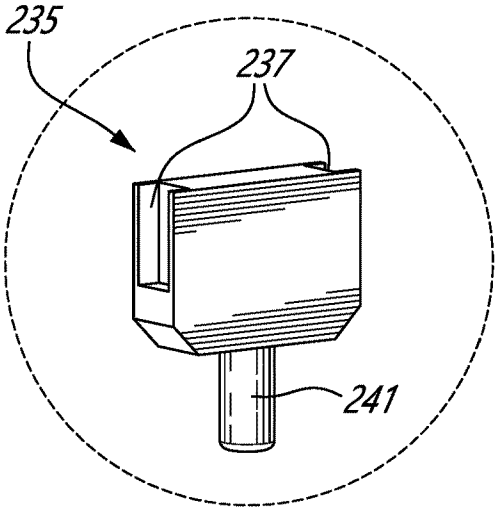
FIG. 10B is the portion 10B-10B of FIG. 10A, shown enlarged.
Figure 10C:
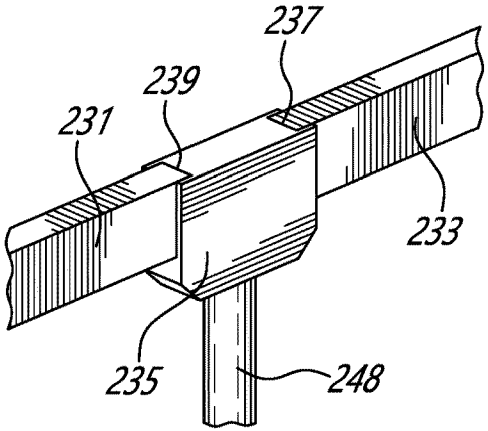
FIG. 10C shows a side coupler of the frame of the spa in FIG. 9 mounted with the first side beam, the second side beam and the side shaft.
Figure 10A:
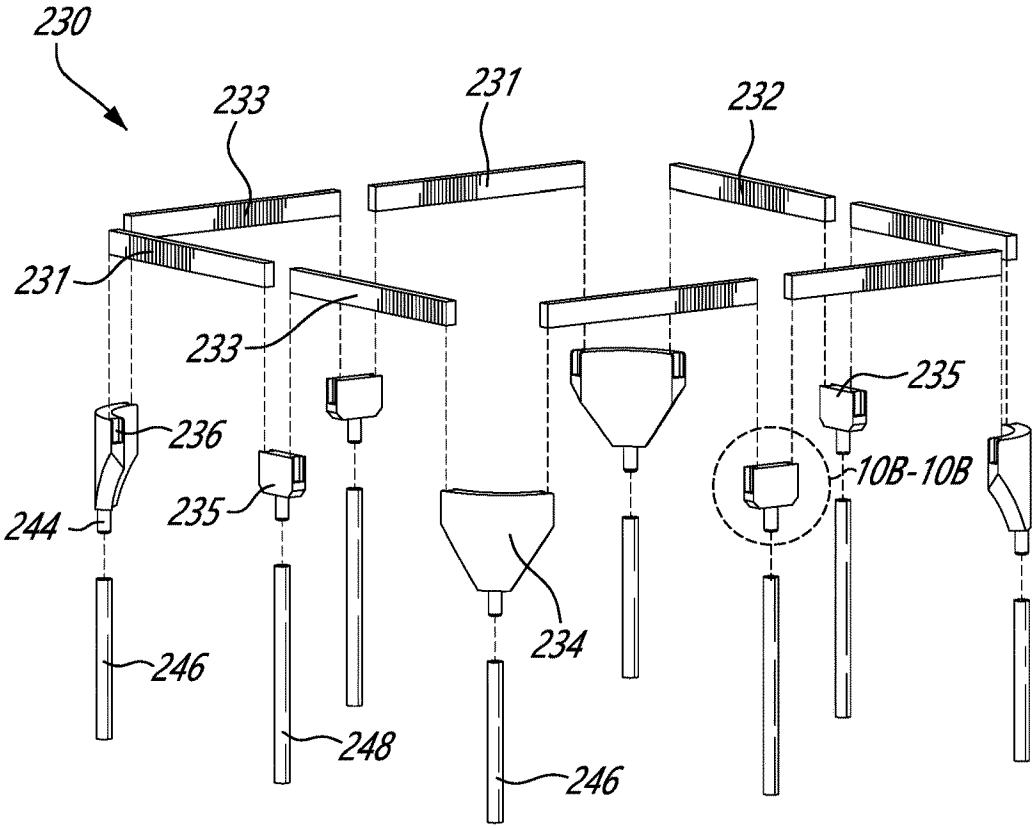
FIG. 10A is an exploded view of the frame in the spa of FIG. 9.

FIG. 10A shows an exploded view of the frame 230 in the spa of FIG. 9. In this embodiment, the frame 230 has a plurality of side beams 232 per side portion 222 of the spa 210 and at least one side coupler 235 configured to receive and connect the plurality of side beams 232 to one another. More specifically, in this embodiment, every side portion 222 of the spa 210 includes a first side beam 231 and a second side beam 233 configured to be received into a side coupler 235. As perhaps best seen in FIGS. 10B and 100, the side couplers 235 have slots 237 with upward facing openings 239 on either lateral side capable of receiving an extremity of the first side beam 231 and an extremity of the second side beam 233. The side couplers 235 further having a peg 241 extending downwardly and configured to receive the side shaft 248. As described in the previous embodiments and perhaps best seen in FIG. 10A, the frame 230 further has couplers 234 configured to receive the first side beam 231 on a first lateral side, the second side beam 233 on the second lateral side and the corner shaft 246 underneath, at each corner portion 224 of the spa 210.

In this particular embodiment, the first side beam 231 and the second side beam 233 are the male connectors and the slots 237 on the couplers 234 and side couplers 235 are the female connectors for mounting the first and second side beams 231, 233. It can, however, be understood that the mounting method between the first or second side beams 231, 233 and the coupler 234 and/or the side coupler 235 can vary without departing from the present disclosure. For example, in an alternate embodiment, the side couplers have male connectors on both lateral sides configured to interface with female elements on the first and second side beams. In another alternate embodiment, the couplers have male connectors on both lateral sides configured to interface with female elements on the first and second side beams. In yet another alternate embodiment, the complementary coupler and side coupler connections for a given side beam have reciprocal connector types, giving rise to a side beam mounting orientation.

Similarly, the coupler 234 and the side coupler 235 pegs 244, 241 are the male connectors and the corner shafts 246 or the side shafts 248 are the female connectors for mounting the corner shafts 246 or side shafts 248 to the couplers 234 or side couplers 235, respectively. It can be understood that the mounting method between these components can vary without departing from the present disclosure. In this example, the corner and side shafts are hollow throughout their length. It can be understood that, in alternate embodiments, the corner and side shafts are only hollow for portions of their length or, in the case when the coupler or side coupler is a female connector, solid throughout.

Returning to FIG. 9, the frame 230 can be introduced into the cavity 128 through one or a plurality of the openings 226 found on the peripheral wall 218 of the shell 212 and assembled inside the cavity 228. Each of the first 231 and second 233 side beams are to be placed along a side portion 222 of the spa 210, in abutment with the upper edge 216 of the shell 212. Each of the first 231 and second 233 side beam has a first end mounted in the slots 236 of the couplers 234. The couplers 234 are placed in the corner portions 224 of the spa 210, also in abutment with the upper edge 216 of the shell 212 and held in place by the corner shaft 246 engaged with the coupler's peg 244. The free end of each of the first 231 and second 233 side beams is mounted in the slots 237 of the side couplers 235. In this embodiment, the side couplers 235 are placed in the side portion 222 of the spa 210 between the first side beam 231 and the second side beam 233 of the same side portion 222. The side couplers 235 are also placed in abutment with the upper edge 216 of the shell 212 and held in place by the side shaft 248 engaged with the side coupler's peg 241.

Once assembled the frame's first side beams 231, second side beams 233, couplers 234 and side couplers 235 are in continuous abutment with, but decoupled from, the upper edge 216 of the shell 212. The frame 230 offers a superior structure and support to the spa 210, helping it maintain lateral rigidity while minimizing local deformation and thermal deformation related stress.

As can be understood, the examples described above and illustrated are intended to be exemplary only. For instance, in the embodiments above, there is a singular corner shaft or side shaft per corner portion or side portion of the spa, but the frame can be adapted to receive a plurality of corner shafts or side shafts per portion. For example, in an alternate embodiment, the couplers are configured to receive two corner shafts per corner portion. The scope is indicated by the appended claims.

What is claimed is:

1. A spa comprising:

a unibody shell defining a basin, an upper edge surrounding the basin, a peripheral wall, a cavity between the basin and the peripheral wall, and at least one opening in the peripheral wall leading to the cavity, and a frame having a plurality of components, each component of the frame being configured for occupying a respective position in the cavity, each component of the frame being configured to be introducible into the cavity, and placed in the respective position, via said at least one opening in the outer wall, so as to be assemblable into the unibody shell within the cavity.

2. The spa of claim 1, wherein a portion of the frame is in abutment with the upper edge of the unibody shell.

3. The spa of claim 2, wherein the portion of the frame is a continuous portion of the frame extending along the upper edge and surrounding the basin.

4. The spa of claim 1, wherein the frame is decoupled from the unibody shell.

5. The spa of claim 1, wherein the components of the frame include a plurality of side beams and corner shafts, the side beams configured to be received in side portions of the unibody shell and the corner shafts configured to be received in corner portions of the unibody shell and support the side beams.

6. The spa of claim 5, wherein the components of the frame includes side shafts configured to be received in the side portion of the unibody shell and support the side beams.

7. The spa of claim 6, wherein the side shafts are fixed to the peripheral wall.

8. The spa of claim 5, wherein the components of the frame include couplers configured to be received in the corner portions of the unibody shell and couple the side beams with the corner shafts.

9. The spa of claim 8, wherein the couplers have a least one peg extending from a bottom side, the corner shaft having a at least partially hollow body configured to receive the peg therein.

10. The spa of claim 8, wherein the side beams have rectangular cross-sections constant along their length and the couplers have lateral sides with slots shaped to receive the rectangular cross-section of the side beams.

11. The spa of claim 10, wherein the slots have a upward facing opening.

12. The spa of claim 5, wherein the side beams are placed in abutment with the upper edge surrounding the basin.

13. The spa of claim 12, wherein the couplers are placed in abutment with the upper edge surrounding the basin.

14. The spa of claim 5, wherein the unibody shell further defines a base, the base having a locating bulge configured to snugly receive a lower extremity of the corner shafts.

15. The spa of claim 1, the side beams are pieces of dimensional lumber.

16. The spa of claim 1, further comprising at least one panel configured to be assembled to the shell to cover the openings of the peripheral wall.

17. A spa having a basin, a peripheral wall surrounding the basin, at least one opening in the peripheral wall, at least one panel having external edges including two opposite lateral edges slanted off vertical towards one another and forming a tapered shape in the vertical orientation, the opening having internal edges forming a tapered shape matching with the tapered shape of the panel, the internal edges configured to form a male-female engagement with the external edges, wherein the panel can be assembled to close the opening by firstly positioning the panel in a plane of the opening, in a position vertically offset towards the width of the taper, from the position of the opening, secondly sliding the panel from the vertically offset position towards the narrow of the taper, into a vertically aligned position, thereby engaging the external edges with the internal edges, and locking the panel into its vertically aligned position to lock the male-female engagement between the internal edges and the external edges.

18. The spa of claim 17, wherein the internal edge forms a groove and a tolerance spacing is provided between a groove root and a groove tip when the panel is engaged with the peripheral wall, the tolerance spacing permitting for thermal contraction and expansion.

19. The spa of claim 18, wherein the assembly of the panel further includes sliding a first one of the lateral edges laterally into the tolerance spacing, pivoting the panel around the first edge towards the peripheral wall, thereby aligning the second one of the lateral edges with the internal edges, and sliding the panel in a horizontally aligned position, thereby engaging the second one of the lateral edges with the internal edges.

20. The spa of claim 17, wherein the panel is secured to the peripheral wall via a fastener, the fastener located centrally with respect to a length of the panel.

* * * * *